US011557242B2

(12) United States Patent
Kang

(10) Patent No.: US 11,557,242 B2
(45) Date of Patent: Jan. 17, 2023

(54) DISPLAY APPARATUS

(71) Applicant: LG Display Co., Ltd., Seoul (KR)

(72) Inventor: YeonWook Kang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/727,582

(22) Filed: Apr. 22, 2022

(65) Prior Publication Data

US 2022/0270534 A1 Aug. 25, 2022

Related U.S. Application Data

(63) Continuation of application No. 17/121,061, filed on Dec. 14, 2020, now Pat. No. 11,341,887.

(30) Foreign Application Priority Data

Dec. 27, 2019 (KR) ..... 10-2019-0176125

(51) Int. Cl.
*G09G 3/20* (2006.01)

(52) U.S. Cl.
CPC ..... *G09G 3/20* (2013.01); *G09G 2310/0275* (2013.01); *G09G 2310/08* (2013.01); *G09G 2330/06* (2013.01)

(58) Field of Classification Search
CPC .. G09G 3/20; G09G 2310/08; G09G 2330/06; G09G 2310/0275
See application file for complete search history.

(56) References Cited

U.S. PATENT DOCUMENTS

2014/0198135 A1* 7/2014 Eom ..... G09G 3/3275 345/82
2018/0059838 A1 3/2018 Chung et al.
2018/0090046 A1 3/2018 Hong et al.

FOREIGN PATENT DOCUMENTS

KR 10-0880222 B1 1/2009
KR 10-2009-0022052 A 3/2009
KR 10-2012-0025657 A 3/2012
WO WO 2012/033332 A2 3/2012

OTHER PUBLICATIONS

United States Office Action, U.S. Appl. No. 17/121,061, dated Oct. 1, 2021, 7 pages.

* cited by examiner

*Primary Examiner* — Gerald Johnson
(74) *Attorney, Agent, or Firm* — Fenwick & West LLP

(57) ABSTRACT

A display apparatus is disclosed, which comprises a display panel including pixels connected to the gate lines and data lines, a data driver configured to sequentially output data signals and output selection signals, and a distributor comprised of transistors connected to each of the data lines and switched in accordance with the selection signal to output the data signals sequentially output from each of a plurality of source channels to the connected data lines, wherein a cycle of each of the selection signals has a transistor-on period and a transistor-off period, a first cycle of a first selection signal among the selection signals is different from a second cycle of the first selection signal, and a first transistor-off period in the first cycle of the first selection signal is different from a second transistor-off period in the second cycle of the first selection signal.

20 Claims, 8 Drawing Sheets

DISPLAY APPARATUS

CROSS-REFERENCE TO RELATED APPLICATIONS

This application is a continuation of U.S. patent application Ser. No. 17/121,061 filed on Dec. 14, 2020, which claims the benefit of the Republic of Korea Patent Application No. 10-2019-0176125 filed on Dec. 27, 2019, each of which is hereby incorporated by reference as in its entirety.

TECHNICAL FIELD

The present disclosure relates to a display apparatus, and more particularly, to a display apparatus that may reduce electromagnetic interference (EMI) noise of a data driver while maintaining a current voltage level.

DESCRIPTION OF THE RELATED ART

A display apparatus is used to display a screen in various types of apparatuses such as a notebook computer, a tablet computer, a smart phone, a portable display device and a portable information device in addition to a television or a monitor.

With the development of a process technology and a driving circuit technology of the display apparatus, pixels per inch (PPI) have been continuously increased, whereby a display apparatus of high resolution has been embodied.

The display apparatus includes a display panel, a data driver integrated circuit (D-IC) and a gate driver integrated circuit (G-IC) for driving the display panel, and a timing controller (T-con) for controlling the ICs. The T-con may be provided outside the ICs, but may be provided inside the ICs.

The display panel is defined by a plurality of data lines and a plurality of gate lines, and includes a pixel having a thin film transistor. The D-IC supplies a data voltage to the data lines, and the G-IC supplies a scan signal to the gate lines in due order.

A source channel of the D-IC, from which the data voltage is output, may be connected with the data line through a connection line, and one source channel may be connected with the plurality of data lines to reduce the number of source channels of the D-IC.

To this end, a distributor comprised of transistors connected to each of the data lines, operating in accordance with a selection signal MUX_S from the D-IC is provided between the source channel and the data lines. If the transistor is turned on by the selection signal MUX_S, the data voltage output from the source channel is supplied to the data line connected with the transistor which is turned on.

In the display apparatus of the related art, since the selection signal MUX_S is output based on the scan signal having a certain period which is fixed, the selection signal MUX_S has no option but to be output for one horizontal period 1H of the scan signal at a fixed period 1H. Likewise, the data signal Source has no option but to be output at a fixed period 1H.

Meanwhile, FIG. 1 is a view illustrating an example that a square wave having periodicity T is converted to a frequency spectrum.

As shown in FIG. 1, if the square wave having certain periodicity T is converted to a frequency spectrum, a low frequency band which is a base frequency $\omega_o$ has a peak component, and an amplitude of high frequency components $3\omega_o$, $5\omega_o$, $7\omega_o$, . . . is gradually reduced.

Torque pulsation generated at the low frequency band of the square wave acts as EMI noise element, and if lines to which a square wave signal is applied are increased within a certain range and a square wave level is increased, EMI noise is increased proportionally.

As described above, since the selection signal MUX_S and the data signal Source are square waves having periodicity, EMI Noise problem occurs even in the D-IC. Moreover, since the number of transistors provided in the distributor is recently increased to reduce the number of source channels of the D-IC, a solution for EMI Noise problem has been issued for stable driving of the transistor.

In order to solve the EMI Noise problem, it is required to lower the level of the selection signal MUX_S, but a swing of a minimum voltage of 20V is required to drive the transistor, whereby there is a limitation in solving the EMI Noise problem by lowering the level of the selection signal MUX_S.

SUMMARY

The present disclosure has been made in view of the above problems, and it is an object of the present disclosure to provide a display apparatus that may reduce EMI noise of a data driver while maintaining a level of a selection signal at a current voltage.

In addition to the objects of the present disclosure as mentioned above, additional objects and features of the present disclosure will be clearly understood by those skilled in the art from the following description of the present disclosure.

In accordance with an aspect of the present disclosure, the above and other objects can be accomplished by the provision of a display apparatus comprising a display panel including pixels connected to the gate lines and data lines, a data driver configured to sequentially output data signals and output selection signals, and a distributor comprised of transistors connected to each of the data lines and switched in accordance with the selection signal to output the data signals sequentially output from each of a plurality of source channels to the connected data lines, wherein a cycle of each of the selection signals has a transistor-on period and a transistor-off period, a first cycle of a first selection signal among the selection signals is different from a second cycle of the first selection signal, and a first transistor-off period in the first cycle of the first selection signal is different from a second transistor-off period in the second cycle of the first selection signal.

Details according to various embodiments of the present disclosure in addition to the above aspect are included in the following description and drawings.

According to the present disclosure, the selection signal that has changed a phase of a reference selection signal having a transistor on period synchronized with the sub horizontal period is supplied to the distributor comprised of transistors for performing supply and supply cut-off of the data signals between the data driver and the data line.

Therefore, since the transistor on period of the selection signal is not synchronized with the sub horizontal period and the selection signal has no square wave having a constant period, the selection signal may be maintained at a current voltage level and at the same time the EMI noise problem may be solved.

In addition to the effects of the present disclosure as mentioned above, additional advantages and features of the present disclosure will be clearly understood by those skilled in the art from the above description of the present disclosure.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
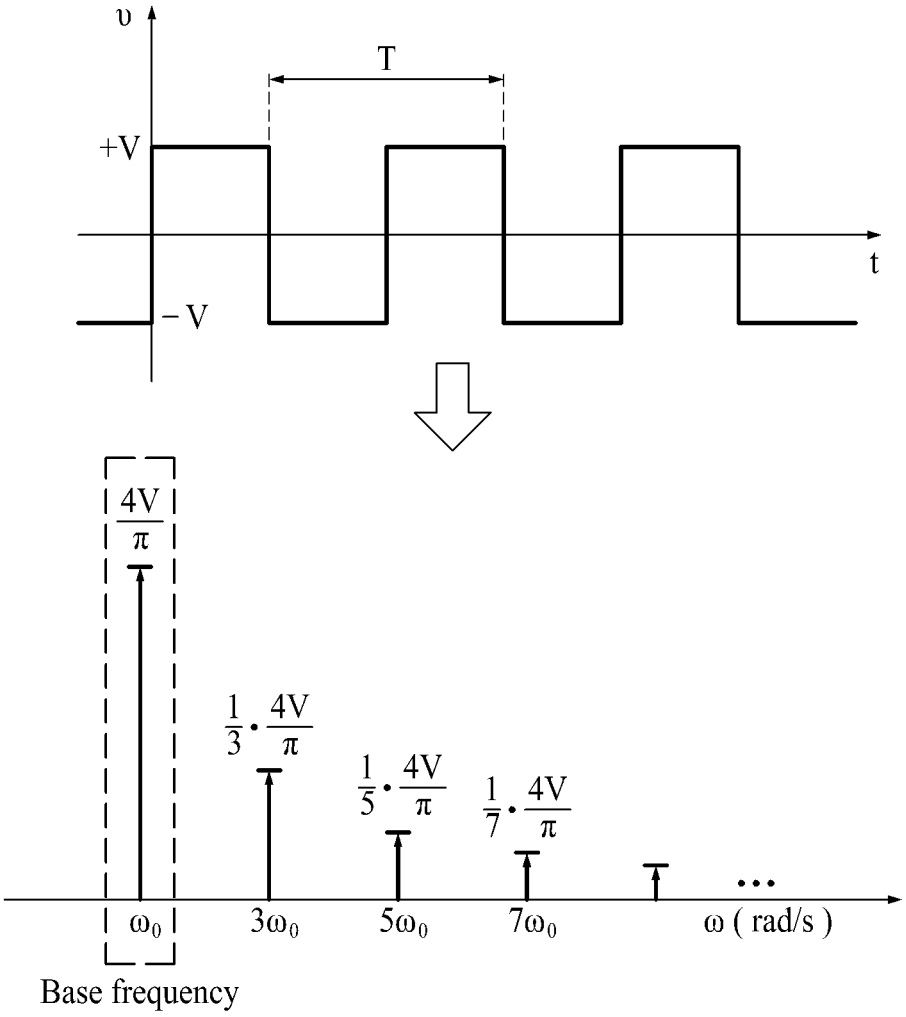
FIG. 1 is a view illustrating an example that a square wave having periodicity T is converted to a frequency spectrum according to related art.

Advantages and features of the present disclosure, and implementation methods thereof will be clarified through the following embodiments, described with reference to the accompanying drawings. The present disclosure may, however, be embodied in different forms and should not be construed as being limited to the embodiments set forth herein. Rather, these embodiments are provided so that this disclosure will be thorough and complete, and will fully convey the scope of the present disclosure to those skilled in the art. Further, the present disclosure is only defined by the scope of the claims.

The shapes, sizes, ratios, angles, and numbers disclosed in the drawings for describing embodiments of the present disclosure are merely examples, and thus the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In the case in which "comprise," "have," and "include" described in the present specification are used, another part may also be present unless "only" is used. The terms in a singular form may include plural forms unless noted to the contrary.

In construing an element, the element is construed as including an error range although there is no explicit description thereof.

In describing a positional relationship, for example, when the positional order is described as "on," "above," "below," and "next," the case of no contact therebetween may be included, unless "just" or "direct" is used.

Spatially relative terms such as "below", "beneath", "lower", "above", and "upper" may be used herein to easily describe a relationship of one element or elements to another element or elements as illustrated in the figures. It will be understood that these terms are intended to encompass different orientations of the device in addition to the orientation depicted in the figures. For example, if the device illustrated in the figure is reversed, the device described to be arranged "below", or "beneath" another device may be arranged "above" another device. Therefore, an exemplary term "below or beneath" may include "below or beneath" and "above" orientations. Likewise, an exemplary term "above" or "on" may include "above" and "below or beneath" orientations.

In describing a temporal relationship, for example, when the temporal order is described as "after," "subsequent," "next," and "before," a case which is not continuous may be included, unless "just" or "direct" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

It should be understood that the term "at least one" includes all combinations related with any one item. For example, "at least one among a first element, a second element and a third element" may include all combinations of two or more elements selected from the first, second and third elements as well as each element of the first, second and third elements.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in a co-dependent relationship.

In the drawings, the same or similar elements are denoted by the same reference numerals even though they are depicted in different drawings.

Hereinafter, a display apparatus according to the present disclosure will be described in detail with reference to the accompanying drawings.

Figure 2:
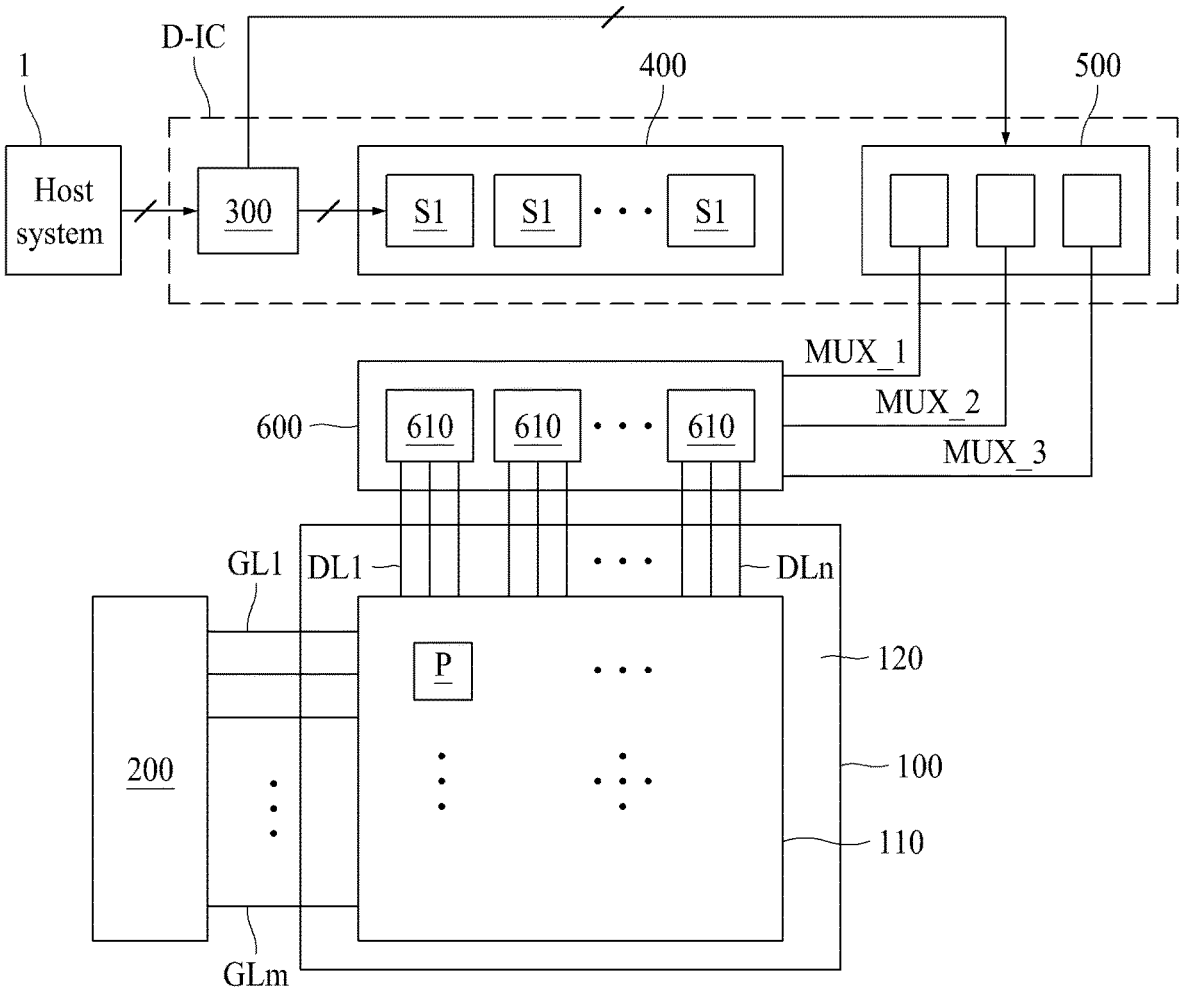
FIG. 2 is a view illustrating an example of a display apparatus according to an embodiment of the present disclosure.

FIG. 2 is a view illustrating an example of a display apparatus according to the embodiment of the present disclosure.

The display apparatus of the present disclosure may be a display apparatus, which may embody a color, such as a liquid crystal display (LCD) device, an organic light emitting display (OLED), an electrophoretic display (EPD), a plasma display panel device (PDP), a field emission display (FED) device, an electro luminescence display (ELD) device, or an electro-wetting display (EWD) device.

The display apparatus according to one embodiment of the present disclosure, as shown in FIG. 2, may include, but is not limited to, a display panel 100, a gate driver 200, a timing controller 300, a source output circuit 400, a selection signal output circuit 500, and a distributor 600. The timing controller 300, the source output circuit 400 and the selection signal output circuit 500 may be embodied as an integrated circuit to constitute one data driver D-IC.

For description, in the present disclosure, one source channel S of the source output circuit 400 may be connected with three data lines through one multiplexer 610 of the distributor 600, whereby n/3 number of source channels S1 to S(n/3) (n is a total number of data lines) are provided in the source output circuit 400. However, one multiplexer 610 may be connected with two data lines or four or more data lines.

The display panel 100 is provided with gate lines GL1 to GLm, data lines DL1 to DLn, and a pixel P formed per pixel area defined by intersection between the gate lines GL1 to GLm and the data lines DL1 to DLn. Although FIG. 2 shows that pixels Ps are formed in the display area 110 of the display panel 100 and the selection signal output circuit 500 and the distributor 600 are provided outside the display panel 100, all or some of the selection signal output circuit 500 and the distributor 600 and all or some of elements of the selection signal output circuit 500 may be provided in a non-display area 120 of the panel 100.

Figure 3:
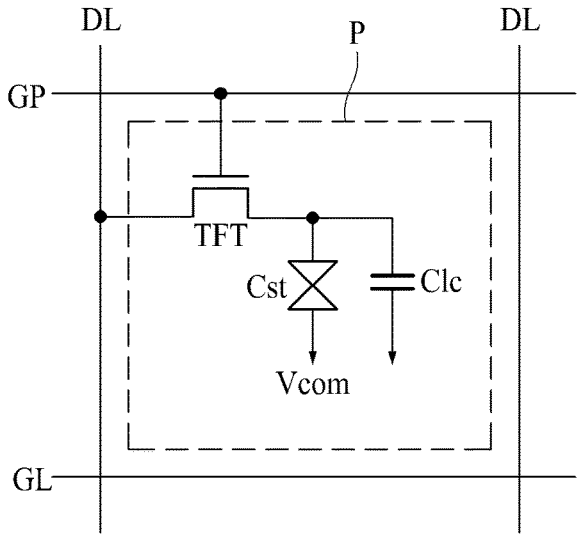
FIG. 3 is an equivalent circuit view illustrating an LCD pixel structure applied to each pixel of FIG. 2 according to an embodiment of the present disclosure.
Figure 4:
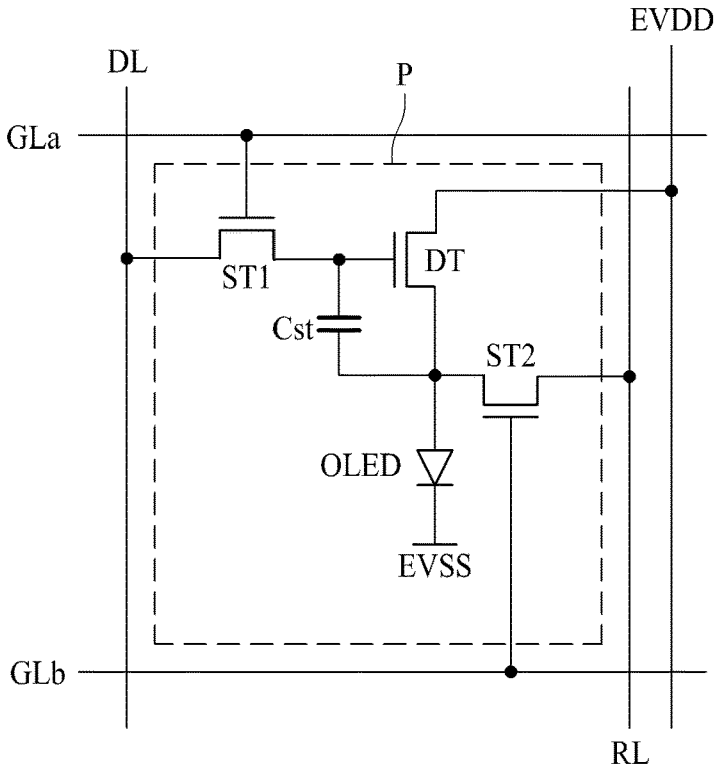
FIG. 4 is an equivalent circuit view illustrating an LCD pixel structure applied to each pixel of FIG. 3 according to an embodiment of the present disclosure.

FIG. 3 is an equivalent circuit view illustrating an LCD pixel structure applied to each pixel of FIG. 2, and FIG. 4 is an equivalent circuit view illustrating an LCD pixel structure applied to each pixel of FIG. 3.

Each pixel P is driven independently by a TFT. An amorphous silicon (A-Si) TFT, a poly-Si TFT, an oxide TFT, or an organic TFT may be used as the TFT.

For example, if the display panel 100 is an LCD panel, as shown in FIG. 3, each pixel P includes a TFT connected with a gate line GL and a data line DL, and a liquid crystal capacitor Clc and a storage capacitor Cst, which are connected between the TFT and a common electrode in parallel.

The liquid crystal capacitor Clc charges a differential voltage between a data signal supplied to a pixel electrode through the TFT and a common voltage Vcom supplied to the common electrode, and controls light transmittance by driving a liquid crystal in accordance with the charged voltage. The storage capacitor Cst stably maintains the voltage charged in the liquid crystal capacitor Clc.

Unlike the above case, if the display panel 100 is an OLED panel, as shown in FIG. 4, each pixel P may be provided with a pixel circuit that includes an OLED connected between a high potential power line EVDD and a low potential power line EVSS, and first and second switching TFTs ST1 and ST2, a driving TFT DT and a storage capacitor Cst to drive the OLED independently.

The OLED includes an anode connected with the driving TFT DT, a cathode connected with the low potential voltage EVSS, a light emitting layer between the anode and the cathode, and generates light proportional to the amount of a current supplied from the driving TFT DT.

The first switching TFT ST1 is driven by a gate signal of one gate line GLa to supply the data voltage from the corresponding data line to a gate node of the driving TFT DT, and the second switching TFT ST2 is driven by a gate signal of another gate line GLb to supply a reference voltage from a reference line RL to a source node of the driving TFT DT. The second switching TFT ST2 is further used as a path for outputting the current from the driving TFT DT to the reference line RL in a sensing mode.

The storage capacitor Cst connected between a gate electrode and a source electrode of the driving TFT DT charges a differential voltage between the data voltage supplied to the gate electrode of the driving TFT DT through the first switching TFT ST1 and the reference voltage supplied to the source electrode of the driving TFT DT through the second switching TFT ST2, and supplies the charged voltage as a driving voltage of the driving TFT DT at a period where the first and second switching TFTs ST1 and ST2 are turned off.

The driving TFT DT controls the current supplied from the high potential power EVDD in accordance with the driving voltage supplied from the storage capacitor Cst to supply the current proportional to the driving voltage to the OLED, thereby allowing the OLED to emit light.

The gate driver 200 outputs a scan signal having a gate on signal $S_{G_ON}$ to each of n number of gate lines GL1 to GLm in due order by using a gate control signal transmitted from the timing controller 300.

In this case, the gate on signal $S_{G_ON}$ means a voltage that may turn on a switching TFT connected to the gate lines GL1 to GLm, and a period where the gate on signal $S_{G_ON}$ is maintained is referred to as one horizontal period 1H.

A voltage that may turn off a switching TFT is referred to as a gate off signal $S_{G_OFF}$, and the gate on signal $S_{G_ON}$ and the gate off signal $S_{G_OFF}$ are collectively referred to as a scan signal.

If the switching thin film transistor is N type, the gate on signal $S_{G_ON}$ is a voltage of a high level, and the gate off signal $S_{G_OFF}$ is a voltage of a low level. If the switching thin film transistor is P type, the gate on signal $S_{G_ON}$ is a voltage of a low level, and the gate off signal $S_{G_OFF}$ is a voltage of a high level.

The data driver D_IC, for examples, receives image data and timing signals synchronized with the image data from a host system 1, converts the received image data to data voltages, outputs one data voltage per sub-horizontal period through one output channel by dividing one horizontal period 1H into a plurality of sub-horizontal periods, and outputs selection signals MUX_s to the distributor comprised of transistors connected to each of the data lines.

The host system 1 is an electronic apparatus embedded with the display apparatus to output an image through the display apparatus. For example, the host system 1 may be a TV (television) system, a set-top box, a navigation system, a DVD player, a Blu-ray player, a personal computer, a home theater system, a phone system, etc.

In this embodiment, the data driver D_IC may include a timing controller 300, a source output circuit 400 and a selection signal output circuit 500, but is not limited thereto.

In this embodiment, although the data driver D_IC includes a timing controller 300 and a selection signal output circuit 500, at least one of the timing controller 300 and the selection signal output circuit 500 may be embodied separately from the data driver D_IC, and the data driver D_IC may be embodied by only the source output circuit 400.

As described above, the following description will be made based on that one source channel S constituting the source output circuit 400 is connected to three data lines through one multiplexer 610 of the distributor 600 and therefore n/3 number of source channels S1 to S(n/3) (n is a total number of data lines) are provided in the source output circuit 400.

The timing controller 300 outputs a gate control signal GCS for controlling an operation timing of the gate driver 200 and a data control signal DCS for controlling an operation timing of the source output circuit 400 by various timing signals (e.g., vertical synchronization signal, horizontal synchronization signal, clock signal, etc.) supplied from the host system 1.

The timing controller 300 samples image data input from the host system 1 and then realigns the sampled image data, supplies the data voltage to the source output circuit 400, and outputs selection signals MUX_s for controlling the operation timing of the distributor 600 comprised of the transistors connected with each of the data lines.

At this time, the timing controller 300 changes a phase of reference selection signals MUX_ref to generate phase-shifted selection signals MUX_s and outputs the generated signal. That is, the selection signals MUX_s are signals phase-shifted from the reference selection signals MUX_ref.

In accordance with setup, the timing controller 300 may phase shift the reference selection signals MUX_s per data line with respect to one frame of image, and may phase shift the reference selection signals MUX_s per frame.

The timing controller 300 may forward phase shift FPS the reference selection signals MUX_ref and backward phase shift (delay) the reference selection signals MUX_ref.

The selection signal MUX_s may be phase-changed to be shifted to a transistor on voltage level prior to a time period shifted to a transistor on voltage level in the reference selection signal MUX_ref, and may be phase-changed to be shifted to a transistor on voltage level later than a time period shifted to a transistor on voltage level in the reference selection signal MUX_ref.

The selection signal MUX_s may be phase-changed to be shifted to a transistor off voltage level prior to a time period shifted to a transistor off voltage level in the reference selection signal MUX_ref, and may be phase-changed to be shifted to a transistor off voltage level later than a time period shifted to a transistor off voltage level in the reference selection signal MUX_ref.

The time period ("first shift time period) shifted to the transistor on voltage level may be a rising edge, and the time period ("second shift time period) shifted to the transistor off voltage level may be a falling edge. The period between the first shift time period and the second shift time period is a turn-on period of the transistor (transistor on period Ton), and the period between the second shift time period and next first shift time period is a turn-off period of the transistor (transistor off period Toff).

Figure 5:
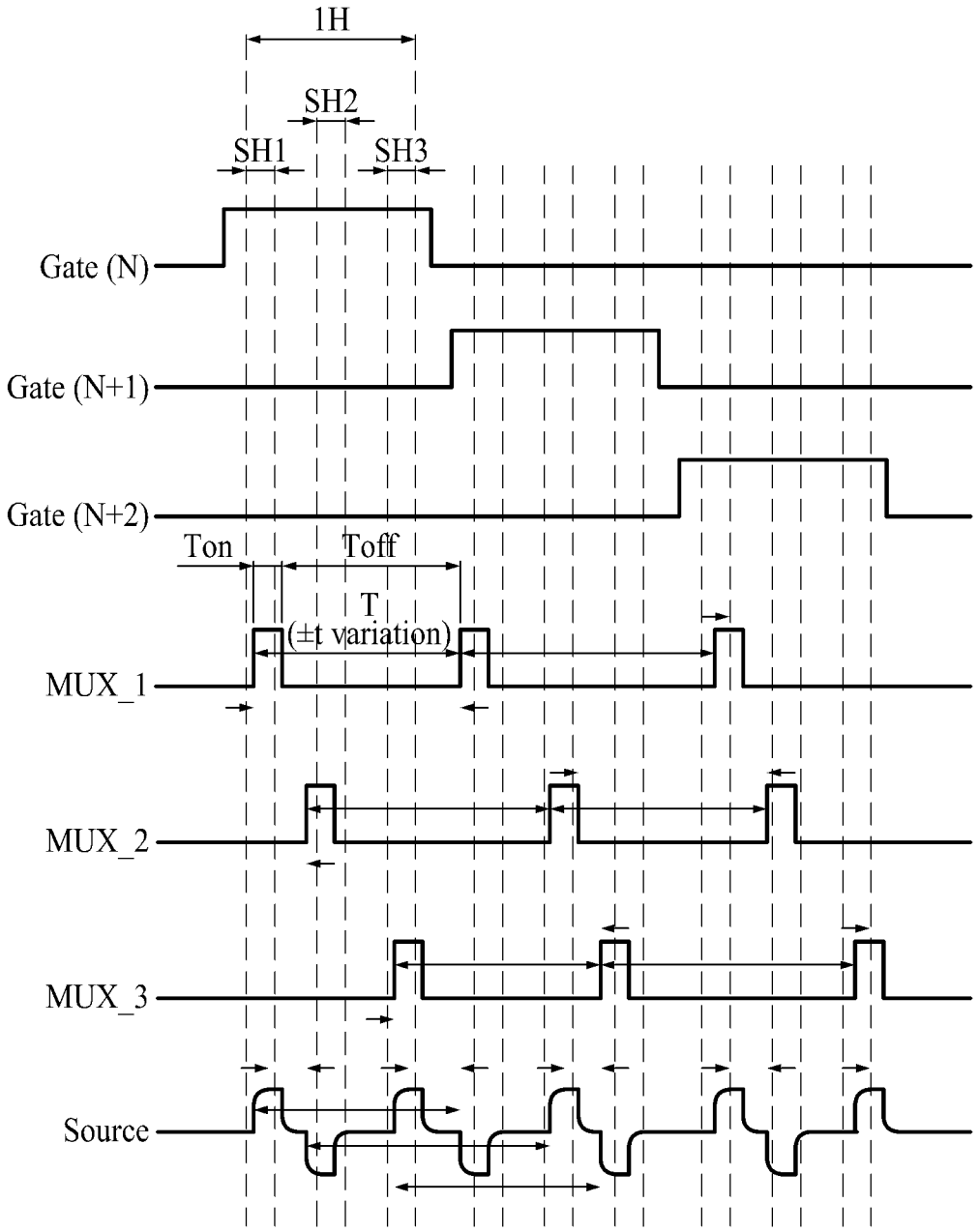
FIG. 5 is a timing view of a scan signal, first to third selection signals and a data signal in a display apparatus according to an embodiment of the present disclosure.

FIG. 5 is a timing view of a scan signal Gate, first to third selection signals MUX_1, MUX_2 and MUX_3 and a data signal Source in a display apparatus according to the embodiment of the present disclosure.

Referring to FIG. 5, the first to third selection signals MUX_1, MUX_2 and MUX_3 may be fixed to the same period 1H as one horizontal period 1H of the scan signal in the related art, but the first to third selection signals MUX_1, MUX_2 and MUX_3 in FIG. 5 may be forward phase shifted or backward phase shifted and therefore have no periodicity.

That is, in the related art, the transistor on period Ton in the first to third selection signals MUX_1, MUX_2 and MUX_3 is the same as first to third sub horizontal periods SH1, SH2 and SH3 preset in one horizontal period 1H of the scan signal. However, the transistor on period Ton in the first to third selection signals MUX_1, MUX_2 and MUX_3 according to the embodiment of the present disclosure may be phase-changed, and therefore may not be the same as the first to third sub horizontal periods SH1, SH2 and SH3 preset in one horizontal period 1H of the scan signal. In FIG. 5, a cycle of each of the first to third selection signals MUX_1, MUX_2 and MUX_3 means a sum of a transistor on period Ton and a transistor off period Toff.

In detail, the selection signal MUX_s may be phase-changed such that the shift time period to the transistor on voltage level may be prior to a start time period of the sub horizontal period SH or may be later than the start time period of the sub horizontal period SH.

The selection signal MUX_s may be phase-changed such that the shift time period to the transistor off voltage level may be prior to an end time period of the sub horizontal period SH or may be later than the end time period of the sub horizontal period SH.

In the selection signal MUX_s, an interval T between an nth first shift time period and an (n+1)th first shift time period may be longer or shorter than one horizontal period 1H of the scan signal.

In the selection signal MUX_s, the interval T between the nth first shift time period and the (n+1)th first shift time period may be different from an interval between the (n+1)th first shift time period and an (n+2)th first shift time period.

A start time period of the transistor on period Ton of each of the first to third selection signals MUX_1, MUX_2 and MUX_3 corresponding to the sub horizontal periods SH1, SH2 and SH3 in one horizontal period 1H may be different from a start time period of each of the sub horizontal periods SH1, SH2 and SH3.

For example, the start time period of the transistor on period Ton of the first selection signal MUX_1 corresponding to the first sub horizontal period SH1 in one horizontal period 1H may be prior to or later than the start time period of the first sub horizontal period SH1, the start time period of the transistor on period Ton of the second selection signal MUX_2 corresponding to the second sub horizontal period SH2 in one horizontal period 1H may be prior to or later than the start time period of the second sub horizontal period SH2, and the start time period of the transistor on period Ton of the third selection signal MUX_3 corresponding to the third sub horizontal period SH3 in one horizontal period 1H may be prior to or later than the start time period of the third sub horizontal period SH3.

A more detailed description of the elements and the operation of the timing controller 300 will be described with reference to FIGS. 8 to 10*b*.

The source output circuit 400 converts the image data transmitted from the timing controller 300 to a positive data voltage and a negative data voltage, which correspond to a predetermined polarity inverse pattern, divides one horizontal period 1H into a plurality of sub horizontal periods for one horizontal period 1H for which the scan signal is supplied to the gate line GL, and outputs the data voltages corresponding to one horizontal line.

To this end, the source output circuit 400 may include a plurality of source channels S1 to S(n/3) that convert image data to data voltages and output the converted data voltages by using gamma voltages supplied from a gamma voltage generator (not shown), wherein each source channel S is connected with the multiplexer 610 of the distributor 600.

Figure 6:
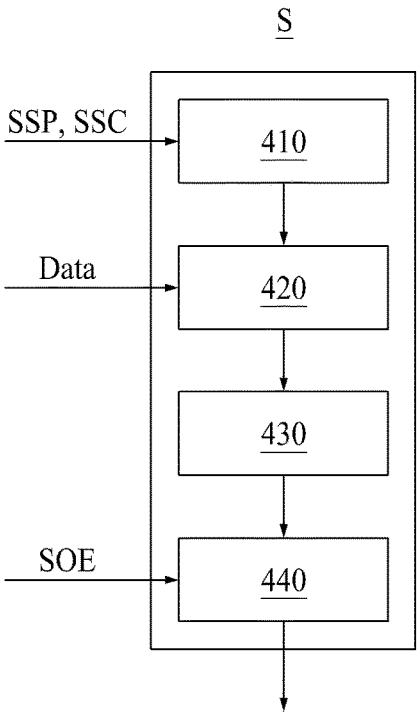
FIG. 6 is a view illustrating elements of any one source channel of a source output circuit according to an embodiment of the present disclosure.

FIG. 6 is a view illustrating elements of any one source channel S of a source output circuit 400 according to the embodiment of the present disclosure. The elements of FIG. 6 may equally be applied to the source channels S1 to S(n/3).

Referring to FIG. 6, the source channel S of the source output circuit 400 may include a shift register 410, a latch 420, a digital-to-analog converter DAC 430, and an output buffer 440, but is not limited this embodiment.

The shift register 410 generates a sampling signal by using the data control signals SSC, SSP, etc. received from the timing controller 300.

The latch 420 latches digital image data sequentially received from the timing controller 300, and at the same time outputs the digital image data to the digital-to-analog converter DAC 430.

The digital-to-analog converter 430 simultaneously converts image data transmitted from the latch 420 to positive or negative data voltages and outputs the converted data voltages. That is, the digital-to-analog converter 430 converts the image data to positive or negative data voltages (data signals) by using a polarity control signal POL transmitted from the timing controller 300 and outputs the converted data voltages.

The output buffer 440 outputs the positive or negative data voltage transmitted from the digital-to-analog converter 430 to the data lines DL in accordance with a source output enable signal SOE transmitted from the timing controller 300.

At this time, the output buffer 440 sequentially outputs a first data voltage, a second data voltage and a third data voltage for a first sub horizontal period, a second sub horizontal period and a third sub horizontal period of the source output enable signal SOE.

The selection signal output circuit 500 is an element for receiving the selection signal MUX_s from the timing controller 300 and outputting the received signal to the distributor 600, and may include a digital-to-analog converter.

In this embodiment, the selection signal output circuit 500 outputs three selection signals MUX_1, MUX_2 and MUX_3 through three output terminals P1, P2 and P3 but is not limited to this embodiment.

The distributor 600 receives the data voltage from the source output circuit 400, receives the selection signal MUX_s from the selection signal output circuit 500, and is switched in accordance with the selection signal MUX_s to output the data voltages input from one source channel S per sub horizontal period to their respective data lines DL1 to DLd different from one another in due order.

The distributor 600 includes a plurality of multiplexers 610 respectively connected to the source channels S1 to S(n/3) of the source output circuit 400, wherein the number of the multiplexer 610 may be set in various ways in accordance with the number of the source channels S of the source output circuit 400.

Figure 7:
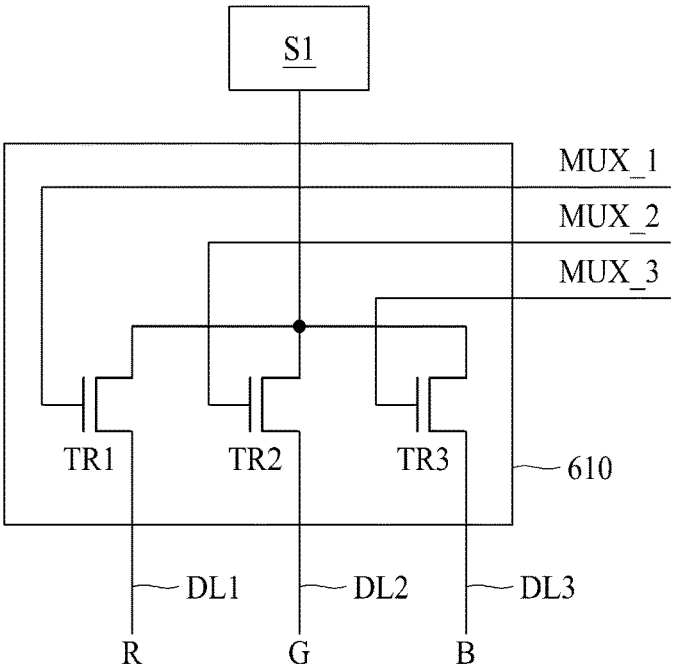
FIG. 7 is a view illustrating elements of a multiplexer of a distributor according to an embodiment of the present disclosure.

FIG. 7 is a view illustrating elements of a multiplexer 610 of a distributor 600 according to the embodiment of the present disclosure.

Although FIG. 7 illustrates that the multiplexer 610 embodied to connect one source channel S1 with each of three data lines, one multiplexer 610 may be embodied to connect one source channel S1 with two data lines or four or more data lines.

Although FIG. 7 illustrates that the first data line DL1 of the three data lines is connected with a red pixel R, the second data line DL2 is connected with a green pixel G and the third data line DL3 is connected with a blue pixel B, this configuration corresponds to the case that the pixel P includes a red pixel, a green pixel and a blue pixel, and the pixel connected with each data line is not limited to this embodiment.

The multiplexer 610 includes a first transistor TR1 connected between the source channel S1 and the first data line DL1, a second transistor TR2 connected between the source channel S1 and the second data line DL2, and a third transistor TR3 connected between the source channel S1 and the third data line DL3.

The first transistor TR1 is turned on in accordance with the first selection signal MUX_1 from the selection signal output circuit 500, the second transistor TR2 is turned on in accordance with the second selection signal MUX_2 from the selection signal output circuit 500, and the third transistor TR3 is turned on in accordance with the third selection signal MUX_3 from the selection signal output circuit 500.

The first data voltage output through the first transistor TR1 is a red data voltage, the second data voltage output through the second transistor TR2 is a green data voltage, and the third data voltage output through the third transistor TR3 is a blue data voltage, but types of the first to third data voltages may be changed depending on colors of pixels to which the first to third data lines DL1 to DL3 are connected.

The elements of the display apparatus according to one embodiment of the present disclosure and the operation for each of the elements have been described as above with reference to FIGS. 1 to 7. Hereinafter, the timing controller 300 of the display apparatus according to one embodiment of the present disclosure will be described in more detail with reference to FIGS. 8 to 10*b*.

Figure 8:
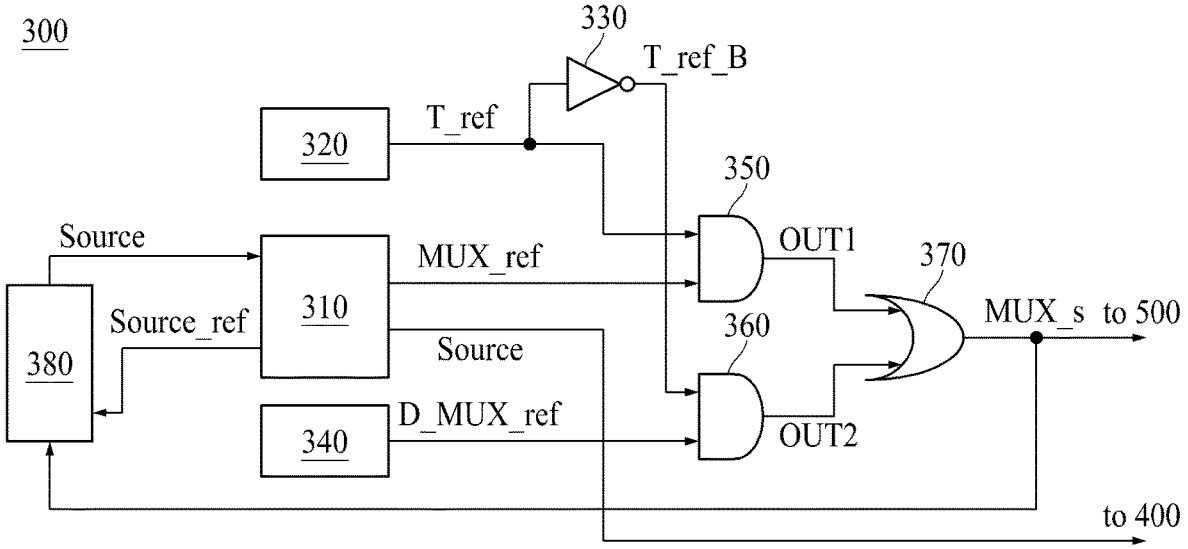
FIG. 8 is a view illustrating elements of a timing controller of a display apparatus according to an embodiment of the present disclosure.
Figure 9:
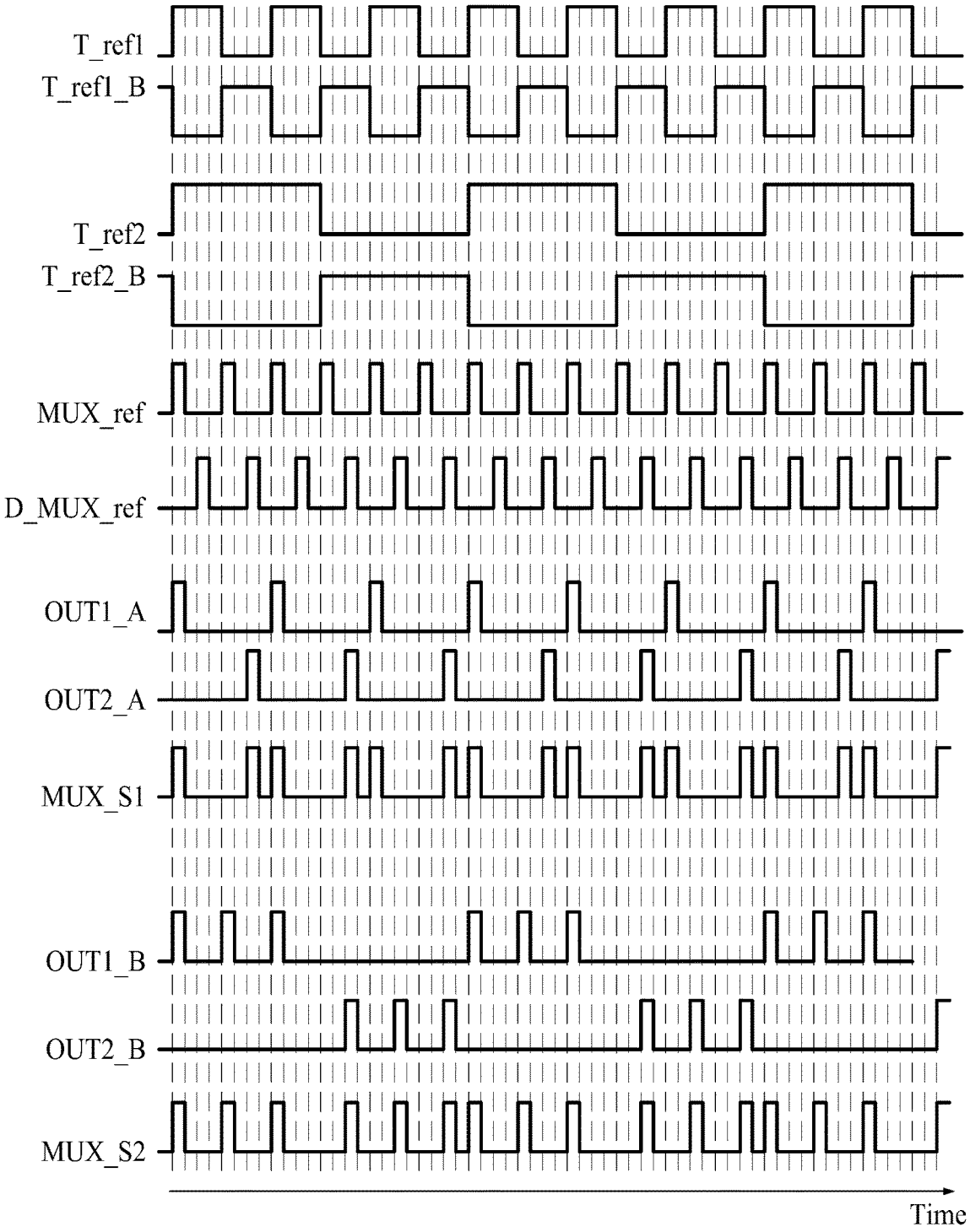
FIG. 9 is a view illustrating an output waveform of each element of a timing controller of FIG. 8 according to an embodiment of the present disclosure.

FIG. 8 is a view illustrating elements of a timing controller 300 of a display apparatus according to the embodiment of the present disclosure, and FIG. 9 is a view illustrating an output waveform of each element of a timing controller 300 of FIG. 8.

Referring to FIGS. 8 and 9, the timing controller 300 may include a base reference signal output circuit 310, a period reference signal output circuit 320, an inverter 330, a delay selection signal output circuit 340, a first AND gate 350, a second AND gate 360, an OR gate 370, and a phase locked loop PLL 380, and its elements are not limited to this embodiment.

The base reference signal output circuit 310 outputs the reference selection signal MUX_ref and a reference data signal Source_ref, wherein the reference selection signal MUX_ref is output to the delay selection signal output circuit 340 and the first AND gate 350, and the reference data signal Source_ref is output to the phase locked loop PLL 380.

Also, the base reference signal output circuit 310 outputs the data signal Source returning from the phase locked loop PLL 380 to the source output circuit 400, and the data signal Source is the reference data signal Source_ref phase synchronized with the selection signal MUX_s output from the OR gate 370 by the phase locked loop 380.

The period reference signal output circuit 320 outputs a period reference signal T_ref for determining a use period for the selection signal MUX_s finally output from the timing controller 300.

The period reference signal T_ref output from the period reference signal output circuit 320 may be selected from a plurality of period reference signals T_ref, and the period reference signal T_ref which is output may be changed within the plurality of period reference signals T_ref.

FIG. 9 illustrates output waveforms of the elements when waveforms of the reference selection signals MUX_ref are the same as one another and different period reference signals T_ref are output.

As noted from FIG. 9, if the waveforms of the reference selection signals MUX_s are the same as one another, the waveform of the first selection signal MUX_s1 when the first period reference signal T_ref1 is output and the waveform of the second selection signal MUX_s2 when the second period reference signal T_ref2 is output are varied.

That is, the selection signal MUX_s finally output from the timing controller 300 is changed in accordance with the period reference signal T_ref output from the period reference signal output circuit 320.

Therefore, it is required to control which one of the plurality of period reference signals T_ref is output from the period reference signal output circuit 320, and the period reference signal T_ref to be output from the period reference signal output circuit 320 may be determined automatically in accordance with an inner clock.

Alternatively, although the base reference signal output circuit 310 may output the control signal for changing the period reference signal T_ref to the period reference signal output circuit 320 in accordance with the preset reference, the method for selecting the period reference signal is not limited to this embodiment.

The inverter 330 inverts the period reference selection signal T_ref output from the period reference signal output circuit 320 to output an inverse period reference signal T_ref_B.

The delay selection signal output circuit 340 delays the reference selection signal MUX_ref from the base reference signal output circuit 310 to output the delayed reference selection signal D_MUX_ref.

The first AND gate 350 performs AND operation by using the reference selection signal MUX_ref output from the base reference signal output circuit 310 and the period reference signal T_ref output from the period reference signal output circuit 320 as inputs.

The second AND gate 360 performs AND operation by using the inverse period reference signal T_ref_B output from the inverter 330 and the delayed reference selection signal D_MUX_ref output from the delay selection signal output circuit 340 as inputs.

The OR gate 370 performs OR operation by using a first output signal OUT1 from the first AND gate 350 and a second output signal OUT2 output from the second AND gate 360 as inputs.

The signal output by the OR gate 370 is the selection signal MUX_s which is a final output of the timing controller 300.

The selection signal MUX_s output from the OR gate 370 is output to the selection signal output circuit 500 and the phase locked loop 380 of FIG. 8.

The phase locked loop 380 receives the reference data signal Source_ref output from the base reference signal output circuit 310 and the selection signal MUX_s output from the OR gate 370, synchronizes the reference data signal Source_ref with the selection signal MUX_s and outputs the synchronized signal.

The reference data signal ('data signal') Source output by being phase synchronized with the selection signal MUX_s by the phase locked loop 380 returns to the base reference signal output circuit 310.

Figure 10A:
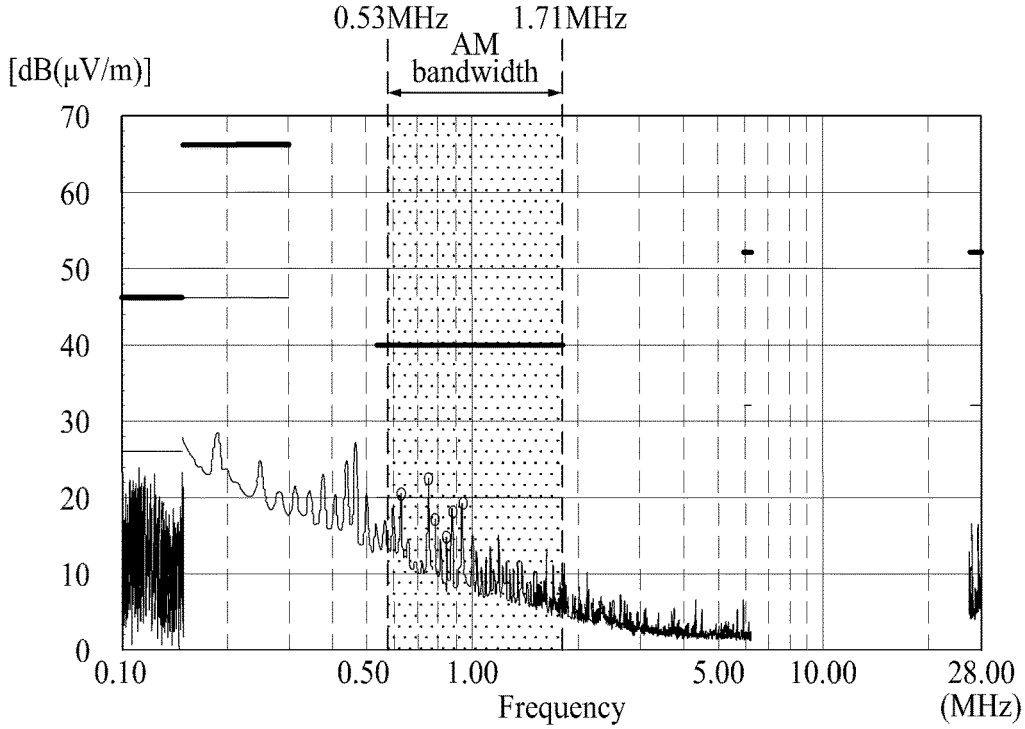
FIG. 10A is a graph illustrating a measured result of EMI noise generated during an operation of a data driver in the case that an output period of a selection signal is fixed like the related art.
Figure 10B:
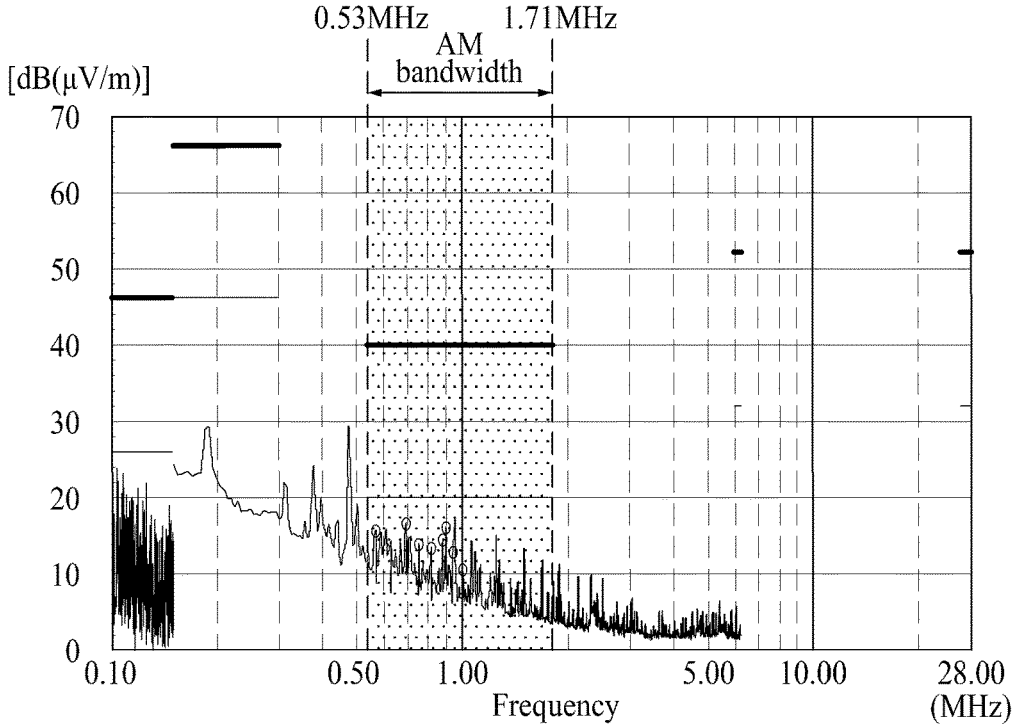
FIG. 10B is a graph illustrating a measured result of EMI noise generated during an operation of a data driver in the case that an output period of a selection signal is changed like an embodiment of the present disclosure.

FIG. 10A is a graph illustrating a measured result of EMI noise generated during an operation of a data driver in the case that an output period of a selection signal is fixed like the related art, and FIG. 10B is a graph illustrating a measured result of EMI noise generated during an operation of a data driver in the case that an output period of a selection signal is changed like the embodiment of the present disclosure.

As noted from FIGS. 10A and 10B, if the output period of the selection signal is changed, EMI noise is reduced at an AM bandwidth of 0.53 MHZ to 1.71 MHZ.

A display apparatus according to an embodiment of the present disclosure will be described below.

A display apparatus according to an embodiment of the present disclosure may comprise a display panel including pixels formed in a pixel area defined by intersection between gate lines and data lines, a data driver sequentially outing data signals per sub horizontal period in one horizontal period and outputting a selection signal including a transistor on period corresponding to the sub horizontal period, and a distributor comprised of transistors connected to each of the data lines and switched in accordance with the selection signal to output the data signals sequentially output from each of a plurality of source channels to the connected data lines, the transistor on period in the selection signal may be different from the sub horizontal period.

According to an embodiment of the present disclosure, the data driver may output the selection signal by changing a phase of reference selection signals having the transistor on period synchronized with the sub horizontal period.

According to an embodiment of the present disclosure, the data driver may change the phase of the reference selection signals to allow a first shift time period shifted to a transistor on voltage level to be prior to or later than a start time period of the sub horizontal period.

According to an embodiment of the present disclosure, the data driver may change the phase of the reference selection signals to allow a second shift time period shifted to a transistor off voltage level to be prior to or later than an end time period of the sub horizontal period.

According to an embodiment of the present disclosure, the data driver may change the phase of the reference selection signals to allow an interval between an nth first shift time period and an (n+1)th first shift time period in one selection signal to be different from the one horizontal period.

According to an embodiment of the present disclosure, the data driver may change the phase of the reference selection signals to allow an interval between an nth first shift time period and an (n+1)th first shift time period in one selection signal to be different from an interval between the (n+1)th first shift time period and an (n+2)th first shift time period.

According to an embodiment of the present disclosure, the one horizontal period may include a first sub horizontal period, the selection signal may include a transistor on period corresponding to the first sub horizontal period, and the data driver may change the phase of the reference selection signals to allow a start time period of a transistor on period corresponding to a first sub horizontal period of an nth one horizontal period and a start time period of a transistor on period corresponding to a first sub horizontal period of an (n+1)th one horizontal period to be arranged differently with respect to the first sub horizontal period.

According to an embodiment of the present disclosure, the one horizontal period may include a first sub horizontal period, the selection signal includes a transistor on period corresponding to the first sub horizontal period, and the data driver may change the phase of the reference selection signals to allow a start time period of a transistor on period corresponding to a first sub horizontal period of an nth one horizontal period to be shifted to be prior to a start time period of a first sub horizontal period of the nth one horizontal period and allow a start time period of a transistor on period corresponding to a first sub horizontal period of an (n+1)th one horizontal period to be shifted to be later than a start time period of a first sub horizontal period of the (n+1)th one horizontal period.

According to an embodiment of the present disclosure, the one horizontal period may include a first sub horizontal period, the selection signal may include a transistor on period corresponding to the first sub horizontal period, and the data driver may change the phase of the reference selection signals to allow a start time period of a transistor on period corresponding to a first sub horizontal period of an nth one horizontal period to be shifted to be later than a start time period of a first sub horizontal period of the nth one horizontal period and allow a start time period of a transistor on period corresponding to a first sub horizontal period of an (n+1)th one horizontal period to be shifted to be prior to a start time period of a first sub horizontal period of the (n+1)th one horizontal period.

According to an embodiment of the present disclosure, the one horizontal period may include first, second and third sub horizontal periods, the selection signal may include a first selection signal including a first transistor on period corresponding to the first sub horizontal period, a second selection signal including a second transistor on period corresponding to the second sub horizontal period, and a third selection signal including a third transistor on period corresponding to the third sub horizontal period, and the data driver may change the phase of the reference selection signals to allow a start time period of the first transistor on period to be different from a start time period of the first sub horizontal period, allow a start time period of the second transistor on period to be different from a start time period of the second sub horizontal period, and allow a start time period of the third transistor on period to be different from a start time period of the third sub horizontal period.

According to an embodiment of the present disclosure, the data driver may include a timing controller outputting the data signal and the selection signal, and the timing controller may output the selection signal that has changed a phase of a reference selection signal to allow a transistor on period of the reference selection signal to be different from the sub horizontal period and synchronizes a reference data signal with the phase changed selection signal to output the data signal.

According to an embodiment of the present disclosure, the timing controller may change the phase of the reference selection signal per data line for image of one frame or change the phase of the reference selection signal per image frame.

According to an embodiment of the present disclosure, the timing controller may change the phase of the reference selection signal to be shifted to a transistor on voltage level prior to or later than a time period shifted to the transistor on voltage level in the reference selection signal.

According to an embodiment of the present disclosure, the timing controller may change the phase of the reference selection signal to be shifted to a transistor off voltage level prior to or later than a time period shifted to the transistor off voltage level in the reference selection signal.

According to an embodiment of the present disclosure, the timing controller may include a base reference signal output circuit outputting the reference selection signal and the reference data signal, a period reference signal output circuit outputting a period reference signal, an inverter outputting an inverse period reference signal by using the period reference signal as an input, a delay selection signal output circuit delaying and outputting the reference selection signal, a first AND gate performing an AND operation by using the reference selection signal and the period reference signal as inputs, a second AND gate performing an AND operation by using the inverse period reference signal and the delayed reference selection signal as inputs, an OR gate outputting a selection signal by performing an OR operation using an output of the first AND gate and an output of the second AND gate as inputs, and a phase locked loop receiving the reference data signal and the selection signal and synchronizing the reference data signal with the selection signal to output the synchronized signal.

According to an embodiment of the present disclosure, the base reference signal output circuit may output a reference selection signal selected from a plurality of reference selection signals.

It will be apparent to those skilled in the art that the present disclosure described above is not limited by the above-described embodiments and the accompanying drawings and that various substitutions, modifications, and variations can be made in the present disclosure without departing from the spirit or scope of the disclosures. Consequently, the scope of the present disclosure is defined by the accompanying claims, and it is intended that all variations or modifications derived from the meaning, scope, and equivalent concept of the claims fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display apparatus comprising:

a display panel including pixels connected to gate lines and data lines;

a data driver configured to sequentially output data signals and output selection signals; and a distributor comprised of transistors connected to each of the data lines and switched responsive to the selection signals to output the data signals sequentially output from each of a plurality of source channels to the connected data lines, wherein:

a cycle of each of the selection signals has a transistor-on period and a transistor-off period, a first cycle of a first selection signal among the selection signals is different from a second cycle of the first selection signal, and a first transistor-off period in the first cycle of the first selection signal is different from a second transistor-off period in the second cycle of the first selection signal.

2. The display apparatus of claim 1, wherein:

a first cycle of a second selection signal among the selection signals is different from a second cycle of the second selection signal, and a first transistor-off period in the first cycle of the second selection signal is different from a second transistor-off period in the second cycle of the second selection signal.

3. The display apparatus of claim 1, wherein:

a first cycle of a third selection signal among the selection signals is different from a second cycle of the third selection signal, and a first transistor-off period in the first cycle of the third selection signal is different from a second transistor-off period in the second cycle of the third selection signal.

4. The display apparatus of claim 1, wherein:

the first cycle of the first selection signal is different from or a same as a first cycle of each of other selection signals from the selection signals, and the second cycle of the first selection signal is different from or a same as a second cycle of each of other selection signals from the selection signals.

5. The display apparatus of claim 1, wherein:

a first interval between a start time point of a first horizontal period and a first transition time shifted from a transistor-off voltage level to a transistor-on voltage level of any one selection signal among the selection signals is different from a second interval between a start time point of a second horizontal period and a second transition time shifted from the transistor-off voltage level to the transistor-on voltage level of the any one selection signal.

6. The display apparatus of claim 5, wherein:

the first horizontal period is a first gate-on period of a first gate line among the gate lines, and the second horizontal period is a second gate-on period of a second gate line among the gate lines.

7. The display apparatus of claim 1, wherein the data driver outputs the selection signals by changing a phase of reference selection signals having a transistor-on period synchronized with each of sub horizontal periods, the sub horizontal periods dividing one horizontal period.

8. The display apparatus of claim 7, wherein the data driver changes the phase of the reference selection signals to allow a first shift time shifted from a transistor-off voltage level to a transistor-on voltage level to be prior to or after a start time of the sub horizontal period.

9. The display apparatus of claim 7, wherein the data driver changes the phase of the reference selection signals to allow a second shift time shifted to a transistor-off voltage level to be prior to or later than an end time of the sub horizontal period.

10. The display apparatus of claim 7, wherein the data driver changes the phase of the reference selection signals to allow an interval between an nth first shift time and an (n+1)th first shift time in one selection signal among the selection signals to be different from the one horizontal period.

11. The display apparatus of claim 7, wherein the data driver changes the phase of the reference selection signals to allow an interval between an nth first shift time and an (n+1)th first shift time in one selection signal among the selection signals to be different from an interval between the (n+1)th first shift time and an (n+2)th first shift time.

12. The display apparatus of claim 7, wherein the one horizontal period includes a first sub horizontal period, the selection signal includes a transistor-on period corresponding to the first sub horizontal period, and the data driver changes the phase of the reference selection signals to allow a start time of a transistor-on period corresponding to a first sub horizontal period of an nth one horizontal period and a start time of a transistor-on period corresponding to a first sub horizontal period of an (n+1)th one horizontal period to be arranged differently with respect to the first sub horizontal period.

13. The display apparatus of claim 7, wherein the one horizontal period includes a first sub horizontal period, the selection signal includes a transistor-on period corresponding to the first sub horizontal period, and the data driver changes the phase of the reference selection signals to allow a start time of a transistor-on period corresponding to a first sub horizontal period of an nth one horizontal period to be shifted to be prior to a start time of a first sub horizontal period of the nth one horizontal period and allow a start time of a transistor on period corresponding to a first sub horizontal period of an (n+1)th one horizontal period to be shifted to be later than a start time of a first sub horizontal period of the (n+1)th one horizontal period.

14. The display apparatus of claim 7, wherein the one horizontal period includes a first sub horizontal period, the selection signal includes a transistor-on period corresponding to the first sub horizontal period, and the data driver changes the phase of the reference selection signals to allow a start time of a transistor on period corresponding to a first sub horizontal period of an nth one horizontal period to be shifted to be later than a start time of a first sub horizontal period of the nth one horizontal period and allow a start time of a transistor-on period corresponding to a first sub horizontal period of an (n+1)th one horizontal period to be shifted to be prior to a start time of a first sub horizontal period of the (n+1)th one horizontal period.

15. The display apparatus of claim 7, wherein the one horizontal period includes a first sub horizontal period, a second sub horizontal period, and a third sub horizontal period, the selection signal includes the first selection signal including a first transistor-on period corresponding to the first sub horizontal period, a second selection signal including a second transistor-on period corresponding to the second sub horizontal period, and a third selection signal including a third transistor-on period corresponding to the third sub horizontal period, and the data driver changes the phase of the reference selection signals to allow a start time of the first transistor-on period to be different from a start time of the first sub horizontal period, allow a start time of the second transistor-on period to be different from a start time of the second sub horizontal period, and allow a start time of the third transistor-on period to be different from a start time of the third sub horizontal period.

16. The display apparatus of claim 7, wherein the data driver includes a timing controller outputting the data signal and the selection signal, and the timing controller outputs the selection signal that has changed a phase of a reference selection signal to allow a transistor-on period of the reference selection signal to be different from the sub horizontal period and synchronizes a reference data signal with the phase changed selection signal to output the data signal.

17. The display apparatus of claim 16, wherein the timing controller changes the phase of the reference selection signal per data line for image of one frame or changes the phase of the reference selection signal per image frame.

18. The display apparatus of claim 16, wherein the timing controller changes the phase of the reference selection signal to be shifted to a transistor-on voltage level prior to or later than a time shifted to the transistor-on voltage level in the reference selection signal.

19. The display apparatus of claim 16, wherein the timing controller changes the phase of the reference selection signal to be shifted to a transistor-off voltage level prior to or later than a time shifted to the transistor-off voltage level in the reference selection signal.

20. The display apparatus of claim 16, wherein the timing controller includes:

a base reference signal output circuit outputting the reference selection signal and the reference data signal;

a period reference signal output circuit outputting a period reference signal;

an inverter outputting an inverse period reference signal by using the period reference signal as an input;

a delay selection signal output circuit delaying and outputting the reference selection signal;

a first AND gate performing an AND operation by using the reference selection signal and the period reference signal as inputs;

a second AND gate performing an AND operation by using the inverse period reference signal and the delayed reference selection signal as inputs;

an OR gate outputting a selection signal by performing an OR operation using an output of the first AND gate and an output of the second AND gate as inputs; and a phase locked loop receiving the reference data signal and the selection signal and synchronizing the reference data signal with the selection signal to output a synchronized signal, wherein the base reference signal output circuit outputs a reference selection signal selected from a plurality of reference selection signals.

* * * * *